United States Patent [19]

Tosato et al.

[11] 4,079,817

[45] Mar. 21, 1978

[54] ELEVATOR SYSTEM WITH FISH PLATE FOR CORRECTING AN OUT-OF-TOLERANCE BETWEEN GUIDE DIMENSION

[75] Inventors: Lawrence P. Tosato, Millburn; Clyde M. Mullis, Glen Rock, both of N.J.

[73] Assignee: Westinghouse Electric Corporation, Pittsburgh, Pa.

[21] Appl. No.: 742,472

[22] Filed: Nov. 16, 1976

[51] Int. Cl.[2] ..... B66B 7/02

[52] U.S. Cl. ..... 187/95; 52/30; 52/236.9; 403/406

[58] Field of Search ..... 187/95; 52/30, 291, 52/236.9, 459, 514, 726; 403/13, 341, 405, 406; 238/243

[56] References Cited

U.S. PATENT DOCUMENTS

| | | | |
|---|---|---|---|
| 1,720,202 | 7/1929 | Benjamin | 187/95 |
| 1,888,018 | 11/1932 | Shanafelt | 187/95 |
| 1,901,520 | 3/1933 | Kiesling | 187/95 |
| 1,905,248 | 4/1933 | Skaife | 187/95 |
| 2,463,215 | 3/1949 | Strachan | 187/95 |
| 2,786,242 | 3/1957 | Stephens | 52/291 |

*Primary Examiner*—Robert W. Saifer
*Assistant Examiner*—Jeffrey V. Nase
*Attorney, Agent, or Firm*—D. R. Lackey

[57] ABSTRACT

An elevator system including an elevator car and two horizontally spaced, vertically oriented, guide rail assemblies for guiding the elevator car. Each guide rail assembly includes a plurality of vertically aligned guide rail members, the adjacent ends of which are interconnected via fish plates. At least one of the fish plates includes first and second integral extensions spaced from the back surfaces of the associated guide rail members which include jacking bolts for applying an adjustable force to the associated guide rail members.

2 Claims, 10 Drawing Figures

ELEVATOR SYSTEM WITH FISH PLATE FOR CORRECTING AN OUT-OF-TOLERANCE BETWEEN GUIDE DIMENSION

BACKGROUND OF THE INVENTION

1. Field of the Invention

The invention relates in general to elevator systems, and more specifically to apparatus for correcting out of tolerance "between guide" dimensions of the guide rails in an elevator system.

2. Description of the Prior Art

One of the most important dimensions in an elevator system is the between guide (BG) dimension, which is the horizontal dimension between the guide rails which guide the elevator car in its vertical travel path. The BG dimension must be maintained within a predetermined tolerance in order to achieve a smooth ride without objectionable sway of the elevator car.

The guiding structure for an elevator car includes first and second horizontally spaced, vertically oriented guide rail assemblies, each comprising a plurality of elongated, T-section guide rail members disposed in end-to-end relation.

Brackets are fastened to the associated building, and the guide rail members are fastened to the brackets via rail clips. Out of tolerance BG dimensions at the brackets may be corrected by shimming.

The guide rails are straight when manufactured, but they may become bowed during storage, shipment and installation due to stresses being relieved during this time period. The rails may also become bowed after installation such as by operating a construction hoist on the rails during construction of the building. It is often difficult to achieve the desired BG dimension by shimming at the brackets, and the present trend in building construction has added to this difficulty. The weight of the steel used in a modern building is being reduced by more thorough engineering. While the amount of steel used is adequate for the loads imposed upon the building by the elevators, it does not provide the rigidity previously available at the rail bracket attachment points. This more flexible building structure makes it more difficult to realign the elevator guide rails and to correct BG dimensions that are out of tolerance. The difficulty is compounded when the rail joint, i.e., the joint between adjoining guide rail members, is not close to a bracket.

The guide roller assemblies on the elevator car which co-act with the guide rails to guide the elevator car must be adjusted for the smallest BG dimension encountered over the travel path. If this smallest BG is the result of a substantial bulge, the guide roller assembly may not properly contact the guide surfaces on the guide rails at the widest BG dimension.

SUMMARY OF THE INVENTION

Briefly, the present invention is a new and improved elevator system which includes an elevator car mounted for guided vertical movement in a building. The guiding apparatus includes first and second horizontally spaced, vertically oriented guide rail assemblies, with each guide rail assembly including a plurality of guide rail members connected to a supporting medium in the building, such as steel beams. The adjacent ends of the guide rail members in each guide rail assembly are interconnected via fish plates. At least one of the fish plates includes an intermediate portion to which the ends of the guide rail members to be joined are affixed, and integral extensions which are spaced from the back surfaces of the interconnected guide rail members. The integral extensions include jacking bolts which are adjusted to provide forces on the interconnected guide rail members which correct an out of tolerance BG dimension and restrain the guide rail members to hold the desired BG dimension.

BRIEF DESCRIPTION OF THE DRAWING

The invention may be better understood, the further advantages and uses thereof more readily apparent, when considered in view of the following detailed description of exemplary embodiments, taken with the accompanying drawings in which.

DESCRIPTION OF THE PREFERRED EMBODIMENTS

Figure 1:
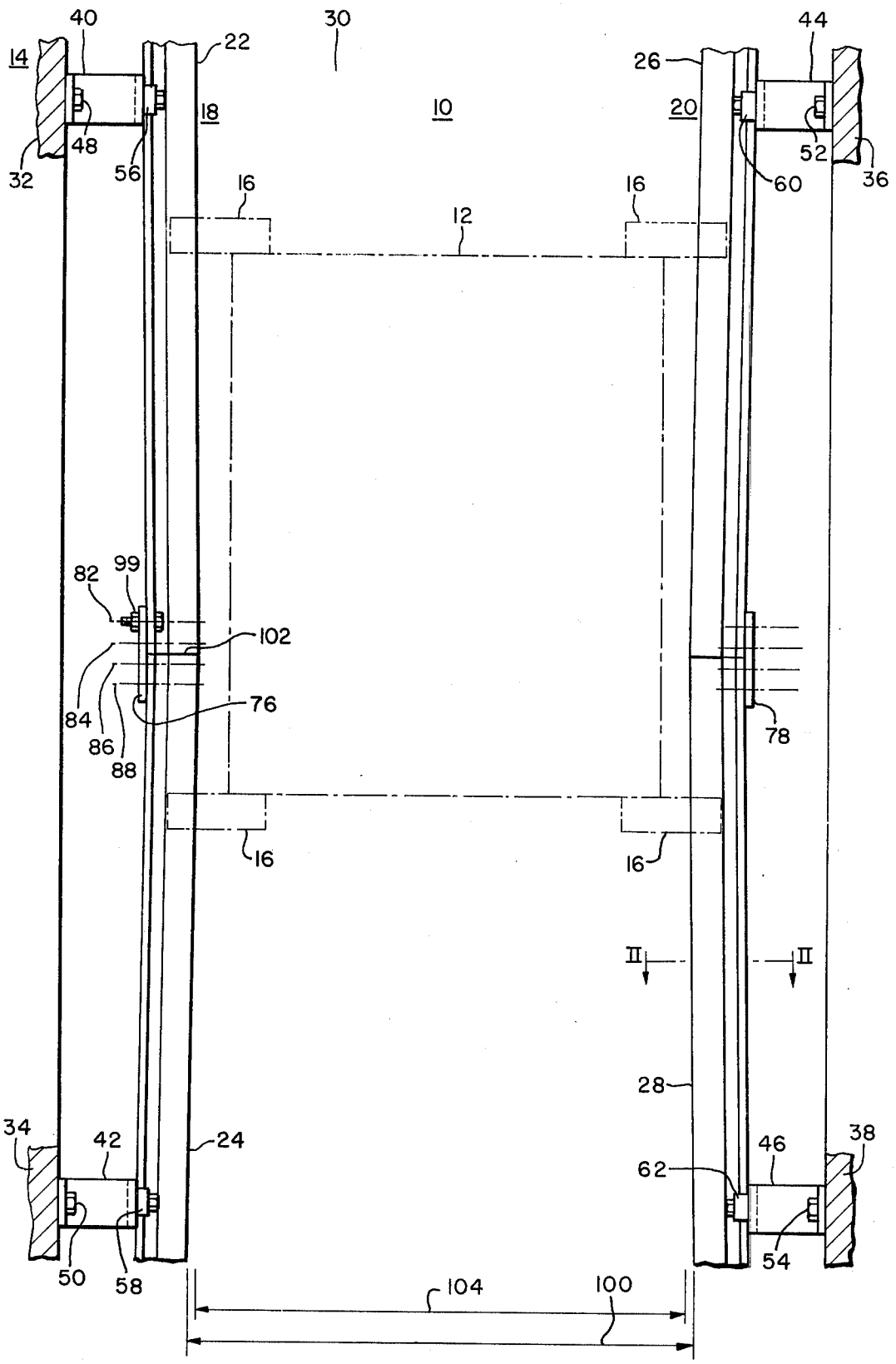
PRIOR ART FIG. 1
FIG. 1 is an elevational view of an elevator system constructed according to the teachings of the prior art.

Referring now to the drawings, and to FIG. 1 in particular, there is shown an elevator system 10 constructed according to the teachings of the prior art. Elevator system 10 includes an elevator car 12, shown in phantom, mounted in a building 14 to serve the floors therein. Elevator car 12 is guided in a vertical travel path by guide apparatus which includes a plurality of guide assemblies 16 carried by the car and first and second guide rail assemblies 18 and 20, respectively. The guide assembly 16 may be guide shoes, or guide roller assemblies, as desired. Guide rail assemblies 18 and 20 are each constructed of a plurality of vertically oriented guide rail members constructed of a suitable metal such as open hearth steel. The guide rail members of each assembly are disposed in end-to-end relation, such as guide rail members 22 and 24 in the first guide rail assembly 18, and guide rail members 26 and 28 in the second guide rail assembly 20. The minimum requirements for the guide rails is set forth in the ANSI A17.1-1971 code for elevators, Rule 200.2a.

The building 14 includes a hoistway 30 in which the elevator system 10 is mounted, with the guide rail assemblies 18 and 20 being secured to a suitable supporting medium within the hoistway 30, such as to steel beams shown generally at 32, 34, 36 and 38.

Bracket members, such as saddle brackets 40, 42, 44 and 46 are suitably fixed to beams 32, 34, 36 and 38, respectively, such as via a plurality of bolts indicated generally at 48, 50, 52 and 54. Guide rail members 22, 24, 26 and 28 are affixed to the saddle brackets 40, 42, 44 and 46, respectively, via rail clips 56, 58, 60 and 62, respectively.

Figure 2:
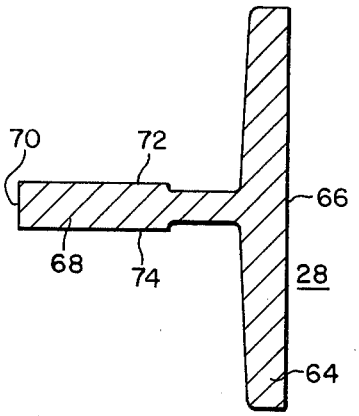
PRIOR ART FIG. 2
FIG. 2 is an enlarged cross sectional view of a guide rail member illustrated in FIG. 1, taken between arrows II—II.

FIG. 2 is an enlarged cross sectional view of guide rail member 28 taken between arrows II—II of FIG. 1. In general, guide rail member 28 has a generally T-shaped cross sectional configuration, including a flange 64 which has a substantially flat back surface 66. A stem 68 extends outwardly from the center of the flange 64, from the side thereof which is opposite to the back surface 66. The stem portion 68 includes the guide surfaces which co-act with the guide assembly 16, to guide the elevator car in its vertical travel path. The guide surfaces include a nose or face guide surface 70 and first and second opposed side guide surfaces 72 and 74, respectively. The rail clips 56, 58, 60 and 62 extend over each edge of the flange 64 to secure the guide rail members to the brackets.

The adjoining ends of the guide rail members are interconnected via fish plate members, such as fish plate 76 which interconnects the adjacent ends of guide rail members 22 and 24, and fish plate 78 which interconnects the ends of guide rail members 26 and 28.

Figure 3:
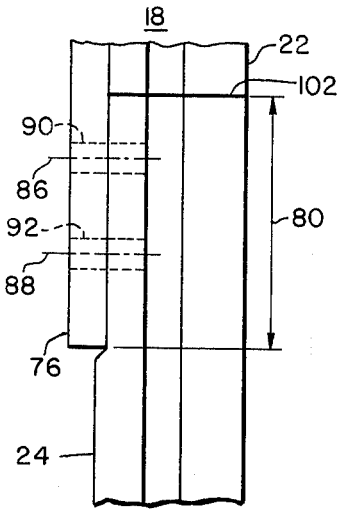
PRIOR ART FIG. 3
FIG. 3 is an enlarged fragmentary view of a guide rail joint and associated fish plate shown in FIG. 1.

The back surfaces 66 of the guide rail members are machined adjacent to each end thereof, such as illustrated in FIG. 3, in order to provide a true flat surface for receiving a fish plate member. FIG. 3 is an enlarged, fragmentary view of the adjoining ends of guide rail members 22 and 24, and their associated fish plate member 76. Guide rail member 24 is machined to provide a flat locating surface for fish plate 76, starting at its end and extending for a predetermined dimension, whih is indicated by arrow 80.

The flange 64 is provided with a plurality of openings on each side of the stem 68 which extend from the machined surface to the opposite side of the flange. These openings are generally indicated in FIG. 1 by center lines 82, 84, 86 and 88, with the center lines 82 and 84 indicating openings through the flange of guide rail member 22, and the center lines 86 and 88 indicating the openings through the flange of guide rail member 24. FIG. 3 illustrates openings 90 and 92 through the flange of guide rail member 24 associated with center lines 86 and 88, respectively. The fish plate members 76 and 78 each have a plurality of openings which are in registry with the openings in the adjacent ends of the guide rail members when the fish plate member is disposed against the machined surfaces adjacent the adjoining ends of the guide rail members. Suitable fastening means, such as nut and bolt assembly 99 are used to firmly secure the fish plate to the guide rail members.

The dimension between the guide rail assemblies 18 and 20, referred to as the "between guide" dimension BG, must be held within a predetermined tolerance in order to assure proper seating of the car carried guide assemblies 16 on the guide surfaces, as well as to assure a smooth ride without objectional sway of the elevator car. The desired between guide dimension, such as indicated at 100 in FIG. 1 is achieved between the brackets by shimming. If the guide rails are not straight, which may occur between the time of manufacture and the time of use due to gradual release of stresses therein, and/or by usage of the guide rails, such as by using the guide rails to guide a construction hoist during the construction of the building, the desired BG dimension may not be achieved, especially at locations which are spaced away from the brackets. This is particularly true when the joints, such as joint 102 between guide rail members 22 and 24, are spaced quite some distance from a bracket. As hereinbefore stated, the more thoroughly engineered modern building structures are more flexible and the BG dimension may change as the building is loaded. Shimming of the brackets to bring the guide rail assemblies back within the BG tolerance has not been entirely successful, and at best is a very tedious, time consuming task. FIG. 1 illustrates an inward bowing of each guide rail assembly 18 and 20, providing a smaller than desired BG dimension, indicated at 104.

The present invention facilitates bringing the guide rail assemblies of an elevator system back within the BG tolerance, making the task of properly aligning the guide rail assemblies quicker and easier, as well as providing better results than those produced by merely shimming the guide rails at the brackets. The present invention enables the BG dimension to be changed at the joints, as well as at the brackets, by a new and improved fish plate 110 shown in FIGS. 4, 5 and 6. Fish plate 110 is substituted for a prior art fish plate wherever the BG dimension is out of tolerance, and the out of tolerance dimension cannot be easily corrected at a bracket by shimming.

Figure 6:
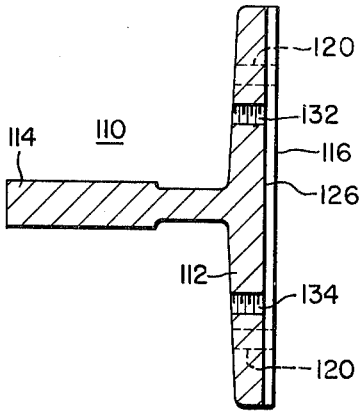
FIG. 6 is an enlarged cross sectional view of the fish plate shown in FIG. 4, taken between and in the direction of arrows VI—VI.
Figure 4:
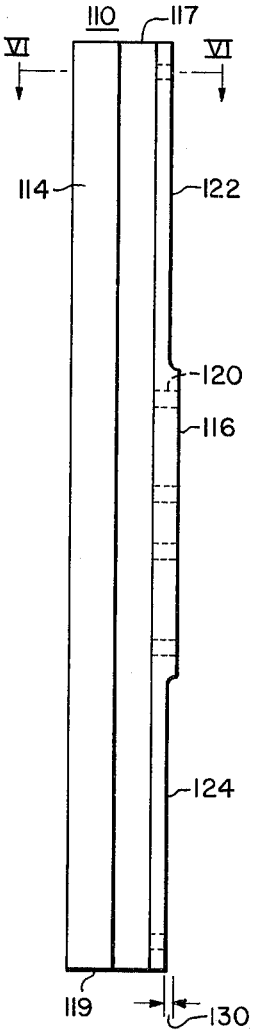
FIG. 4 is a side elevational view of a fish plate constructed according to the teachings of the invention, which may be used in the elevator system shown in FIG. 1.
Figure 5:
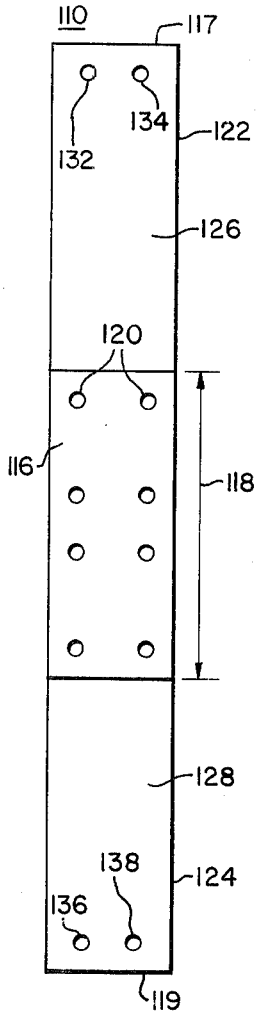
FIG. 5 is a front elevational view of the fish plate shown in FIG. 4.

More specifically, FIGS. 4 and 5 are side and front elevational views, respectively, of a fish plate 110 constructed according to the teachings of the invention, and FIG. 6 is an enlarged, cross sectional view of fish plate 110 taken between and in the direction of arrows VI—VI in FIG. 4. As shown most clearly in FIG. 6, fish plate 110 is preferably constructed from a section of a steel guide rail similar in cross sectional configuration and dimensions to the guide rail members utilized in the guide rail assemblies 18 and 20 of the specific elevator system. Thus, fish plate 110 includes a flange 112 and a stem 114. The stem 114, while not used for its normal guiding function, adds substantially to the stiffness of the fish plate, which stiffness is essential in achieving the desired results with the new fish plate 110.

The new fish plate 110 is formed from a length of steel guide rail, or other suitable material, such as a 4 foot length, for example, and it is machined on its back side to provide an intermediate surface 116 centrally located between its ends 117 and 119, having an axially extending dimension indicated by arrow 118 in FIG. 5 which is the same as the length of the prior art fish plate it is replacing. A plurality of holes or openings 120 are formed through the surface 116, and thus through the flange 112, in the same hole pattern as the prior art fish plate it is replacing. The back side is preferably further machined between surface 116 and end 17, and between surface 116 and end 119, especially if the fish plate is to be used to correct a too small BG dimension, to provide first and second integral extensions 122 and 124, respectively, from the intermediate surface, which extensions have surfaces 126 and 128 in a common flat plane spaced inwardly from the flat plane of surface 116 by a predetermined dimension 130 illustrated in FIG. 4. The dimension 130 is selected such that the extensions 122 and 124 will not contact the back surfaces of the associated guide rails which the intermediate surface 116 is to be fastened to. Tapped openings 132 and 134 are provided through the extension 122, one on each side of the stem 114, near end 117, and in like manner, tapped openings 136 and 138 are provided through extension 124 near end 119. As will be hereinafter explained, the tapped openings receive bolts in a manner depending upon whether the out of tolerance BG dimension is too large or too small.

In describing the use of fish plate 110, it will first be assumed that fish plate 110 is to be used to correct an out of tolerance BG dimension which is too small, and that it will replace the prior art fish plate 76 shown in FIG. 1. The prior art fish plate 76 is unbolted and fish plate 110 bolted to the guide rail members 22 and 24, using the same fastening hardware. The surfaces of extensions 122 and 124 which face the guide rails 22 and 24 are spaced from the associated guide rails, notwithstanding the inward bow of the guide rails at the joint, due to the selected dimension 130 shown in FIG. 4, enabling the intermediate surface 116 to be bolted tightly to the guide rail members 22 and 24.

A plurality of bolts are now threadably engaged with the openings 132, 134, 136 and 138, such as bolts 140 and 142 shown threadably engaged with openings 132 and 136, respectively. When the BG dimension is too small, the bolts are started from the stem side of the flange and they are advanced to contact the back surface 66 of the associated guide rail member. The bolts 140 and 142, being spaced from the joint 102, function as jacking bolts. They are advanced against the back surfaces 66 of the guide rails 22 and 24, applying forces thereto which, due to the stiffness of the fish plate 110, pull the joint 102 towards the wall 150 of the hoistway 30, increasing the BG dimension and taking the bow out of the aligned guide rail members. FIG. 8 illustrates the guide rail assembly 18 of FIG. 7 after the jacking bolts have pulled the joint towards the wall, to align the noses of the guide rails within the specified BG tolerance.

Figure 7:
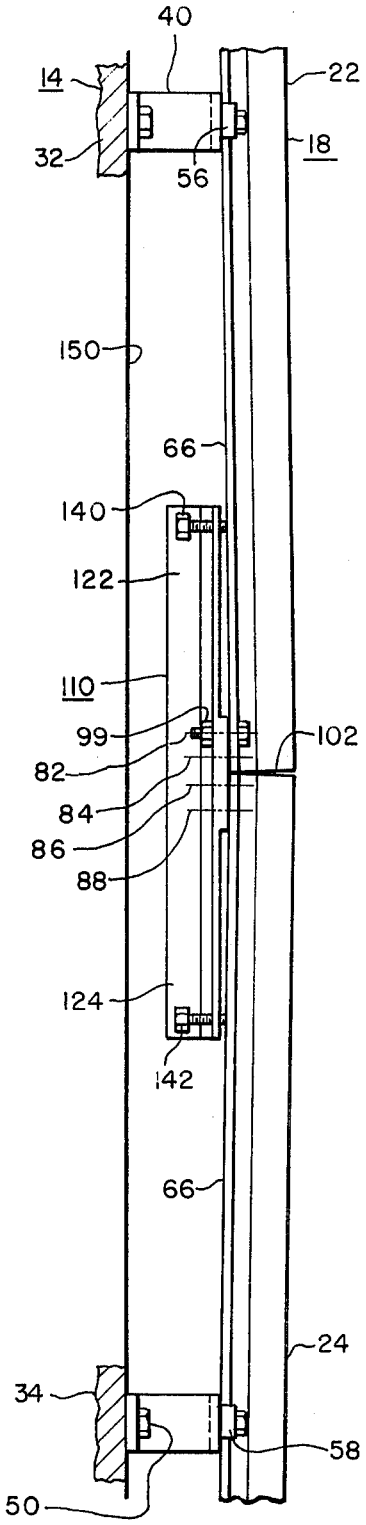
FIG. 7 is an elevational view of an elevator system utilizing a fish plate constructed according to the teachings of the invention, applied to a guide rail assembly of the elevator system to correct an out of tolerance BG dimension which is too small.
Figure 8:
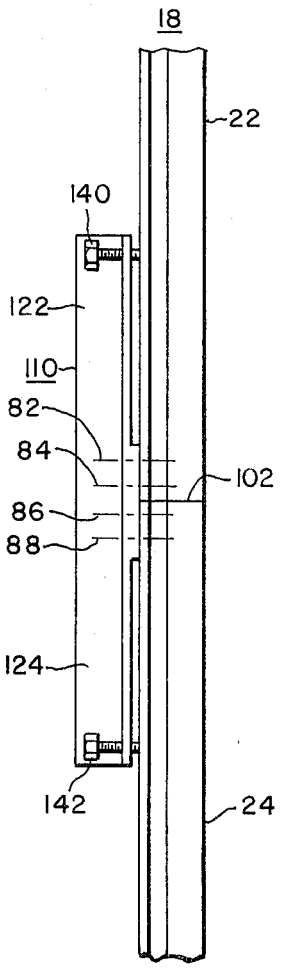
FIG. 8 is an elevational view of the elevator system shown in FIG. 7, after the jacking bolts of the fish plate have been adjusted to correct the out of tolerance BG dimension.
Figure 9:
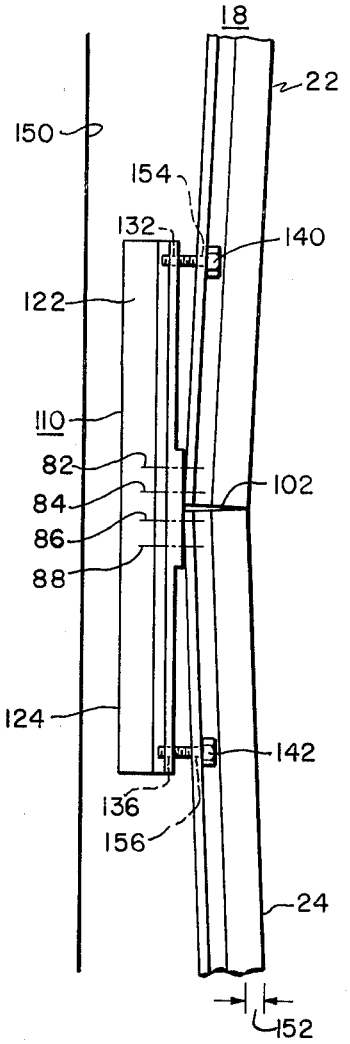
FIG. 9 is an elevational view of an elevator system which includes a fish plate constructed according to the teachings of the invention, applied to a guide rail assembly of the elevator system to correct an out of tolerance BG dimension which is too large.
Figure 10:
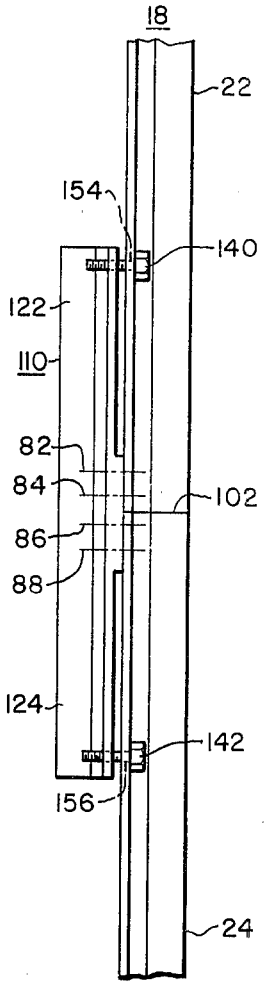
FIG. 10 is an elevational view of the elevator system shown in FIG. 9, after the jacking bolts of the fish plate have been adjusted to correct the out of tolerance BG dimension.

If the BG dimension at fish plate 76 of FIG. 1 exceeded the desired BG dimension plus its tolerance, the fish plate 110 would replace the fish plate 76, as described in the embodiment of FIGS. 7 and 8, but the orientation of the jacking bolts would be reversed. Also, in order to accommodate the reversed orientation of the jacking bolts, suitable holes or openings would be drilled or formed through the guide rail members 22 and 24 in registry with the tapped openings in fish plate 110. FIGS. 9 and 10 illustrate this embodiment of the invention, wherein the BG dimension is larger than desired, exceeding the desired dimension by an amount indicated at 152 in FIG. 9.

More specifically, the prior art fish plate 76 would be unbolted and fish plate 110 would be bolted in its place to the ends of the guide rail members 22 and 24, using the same fastening hardware. If fish plate 110 is being constructed specifically to correct a BG dimension which is too large, the extensions 122 and 124 may not contact the associated guide rail members, and the additional machining of the extensions to provide the clearance required in the first embodiment of the invention is not essential. Openings are then drilled through the flange of the guide rail members 22 and 24, in registry with the tapped openings 132, 134, 136 and 138, such as openings 154 and 156 which are in registry with openings 132 and 136, respectively.

The jacking bolts are then inserted through the openings in the flanges of the guide rail members and they are threadably engaged with the tapped openings of the fish plate 110, entering the openings on the side of the fish plate 110 which is opposite to its stem side. The jacking bolts are advanced such that the underside of the bolt heads contact the flanges of the associated guide rail members, and the bolts are further advanced to apply forces on the guide rails which, due to the stiffness of the fish plate 110, cause the joint 102 to move away from the wall 150 of the hoistway 30 to bring the BG dimension back into tolerance.

Depending upon the specific alignment of the guide rail members of each guide rail assembly, the special fish plate 110 may be applied to one or both guide rail assemblies, as required to correct alignment problems of each assembly.

We claim as our invention:

1. An elevator system comprising:

an elevator car mounted for movement in a vertical travel path, guiding means guiding said elevator car in the vertical travel path, said guiding means including a plurality of elongated, T-section guide rail members each having guide surfaces, a flange, a back surface and first and second ends, means mounting said guide rail members on a supporting medium to provide first and second horizontally spaced, vertically oriented, guide rail assemblies each having a plurality of vertically aligned guide rail members disposed in end-to-end relation, fish plate means interconnecting the adjacent ends of said guide rail members in each of said first and second guide rail assemblies, to form fixed joints between vertically adjacent guide rail members, at least one of said fish plate means including an elongated, vertically oriented metallic member having an intermediate portion and upper and lower portions which extend above and below, respectively, the intermediate portion, said intermediate portion having a flat surface, said upper and lower portions each having flat surfaces which are substantially parallel to the flat surface of the intermediate portion, but spaced therefrom in a direction away from the first and second guide rail members, means securely attaching the adjacent ends of the first and second guide rail members to the flat surface of said intermediate portion, such that portions of the back surfaces of said first and second guide rail members contact the flat surface of the intermediate portion of said fish plate means, said flat surfaces of the upper and lower portions of the at least one first plate means, being spaced from the flat surface of the intermediate portion, enabling the intermediate surface to be attached to the adjacent ends of the first and second guide rails without interference between the flat surfaces of the upper and lower portions and the back surfaces of the first and second guide rail members when the associated joint is too close to the other guide rail assembly, and first and second jacking bolt means threadably engaged with the upper and lower portions, respectively, of said at least one fish plate means, said first and second jacking bolt means contacting and applying adjustable forces against the back surfaces of said first and second guide rail members, respectively, with the forces being proportional to the positions of said first and second jacking bolt means relative to said at least one fish plate means and to said first and second guide rail members, said at least one fish plate means being constructed to provide a stiffness such that the forces applied to the back surfaces of the first and second guide rail members by the first and second jacking bolt means will move the associated joint and increase the horizontal spacing between the joint and a guide rail member of the other guide rail assembly, to provide and maintain a predetermined horizontal dimension between said first and second spaced guide rail assemblies.

2. The elevator system of claim 1 in which the at least one fish plate means has a substantially T-shaped cross sectional configuration similar in dimensions to the first and second adjacent guide rail members it is interconnecting.

* * * * *